US007266921B2

(12) United States Patent
Mc Clellan

(10) Patent No.: US 7,266,921 B2
(45) Date of Patent: Sep. 11, 2007

(54) GUN TRIGGER AND HAMMER SAFETY DEVICE

(76) Inventor: W. Thomas Mc Clellan, 2680 Arbor Dr., Fort Lauderdale, FL (US) 33312

( * ) Notice: Subject to any disclaimer, the term of this patent is extended or adjusted under 35 U.S.C. 154(b) by 0 days.

(21) Appl. No.: 11/212,397

(22) Filed: Aug. 25, 2005

(65) Prior Publication Data

US 2007/0044362 A1 Mar. 1, 2007

(51) Int. Cl.
*F41A 17/00* (2006.01)

(52) U.S. Cl. ..... 42/70.11

(58) Field of Classification Search .... 42/70.06–70.08, 42/70.11

See application file for complete search history.

(56) References Cited

U.S. PATENT DOCUMENTS 4,392,318 A * 7/1983 Daniels ..... 42/70.11
4,825,576 A 5/1989 Troncoso et al.
4,852,286 A 8/1989 Troncoso et al.
4,945,665 A 8/1990 Nelson
5,033,218 A 7/1991 Nelson
5,075,994 A 12/1991 Nishioka
5,621,996 A * 4/1997 Mowl, Jr. ..... 42/70.07
5,724,760 A * 3/1998 Langner ..... 42/70.07
5,910,002 A 6/1999 Hunter
6,568,117 B2 * 5/2003 Weinraub ..... 42/70.11
6,718,678 B2 4/2004 Riebling et al.
6,718,679 B2 4/2004 Herzog
6,722,071 B1 4/2004 Lin
6,766,606 B2 7/2004 Fluhr et al.
6,785,995 B2 9/2004 Herzog et al.
6,799,392 B2 10/2004 Milec et al.
6,862,829 B2 3/2005 McMoore
6,862,831 B1 3/2005 Canaday
6,874,265 B1 4/2005 Pathak
6,883,262 B1 4/2005 Von Muller

* cited by examiner

*Primary Examiner*—Michael J. Carone
*Assistant Examiner*—Gabriel J. Klein
(74) *Attorney, Agent, or Firm*—Laurence A. Greenberg; Werner H. Stemer; Ralph E. Locher

(57) ABSTRACT

A safety device is provided for a handgun having a trigger, a hammer and a trigger guard. The safety device contains a hammer locking end for locking the hammer, a trigger locking end for locking the trigger, and a structural support member extending between the hammer locking end and the trigger locking end. The safety device thus locks both the trigger and the hammer and is releasably connected to the handgun.

19 Claims, 6 Drawing Sheets

GUN TRIGGER AND HAMMER SAFETY DEVICE

BACKGROUND OF THE INVENTION

1. Field of the Invention

The invention relates, generally, to gun safety devices, and more specifically, it relates to a clip-on/clip-off gun trigger and hammer safety device.

2. Description of the Related Art

Safety devices to prevent accidental firing of handguns are well known to those skilled in the art. Such safety devices are available in a variety of configurations. Trigger covers may be attached to a handgun to cover the entire trigger guard preventing access to the trigger. However, such safety covers must be attached by pins or screws and a special tool is required for release of the cover. An example of such a trigger cover is disclosed by U.S. Pat. No. 5,075,994 to Nishioka. Nishioka discloses a trigger cover including a locking device that is unlocked using a tool such as an Allen wrench or a key.

Other such safety devices utilize a locking clamp that holds the trigger in a depressed position thereby preventing the weapon from transitioning to a firing condition. The disadvantage of this type of device is that it must be unlocked with a key if firing is necessary. Although this is effective in preventing a child from firing the gun, it may also inhibit proper use in an emergency situation while searching for the key.

The safety devices described so far have the added disadvantage that they may be readily seen making it apparent to the uninitiated or even a child that the weapon has been disabled. Thus, a criminal is not likely to be deterred when confronted with a weapon having such a safety device installed thereon. Thus, any such safety device that is cumbersome to remove in an emergency situation is undesirable.

U.S. Pat. Nos. 4,852,286 and 4,825,576 to Troncoso et al., disclose detachable gun trigger safety devices configured to span the space between a gun trigger and the rear portion of the trigger guard and wedge the trigger forward to prevent its rearward movement and firing of the gun.

U.S. Pat. Nos. 4,945,665 and 5,033,218 to Nelson both disclose quick-release gun trigger safety devices including a block made of a resilient material that is molded to conform to the inner perimeter of a gun trigger guard. The trigger is held in a depressed state when the block is inserted. The block has flexible flanges formed on both sides that partially extend around the trigger guard and the depressed trigger to hold the block in place.

U.S. Pat. No. 5,910,002 to Hunter discloses a gun trigger safety device for double action revolvers and holds the trigger in an unfireable position. The device is configured to be quick releasing but does not inhibit actuation of the hammer.

It is desirable to provide a trigger safety device for handguns which holds the trigger in an unfireable condition, inhibits actuation of the hammer, and which is capable of quick release in an emergency situation.

Concealed handguns constitute an additional hazard to the handgun user because the user is usually in an excited and adrenaline charged state when he/she is withdrawing the handgun in an emergency situation. When concealed, handguns are carried in close approximation to the body of the user. There is an increased risk of accidental discharge of the handgun and injury to the carrier of the handgun, when the handgun is grasped, and withdrawn rapidly from the pocket, holster or other concealment device.

SUMMARY OF THE INVENTION

It is accordingly an object of the invention to provide a gun trigger and hammer safety device, which overcomes the herein-mentioned disadvantages of the heretofore-known devices of this general type, which functions as both a trigger guard and a hammer guard and is quick releasing.

With the foregoing and other objects in view there is provided, in accordance with the invention, a safety device for a handgun having a trigger, a hammer and a trigger guard. The safety device has a hammer locking end for locking the hammer, a trigger locking end for locking the trigger, and a structural support member extending between the hammer locking end and the trigger locking end.

In accordance with an added feature of the invention, the hammer locking end has first and second sides for form fitting to sides of the handgun. The first side has an inner side engaging one of the sides of the handgun and an outer side having a beveled protrusion. The beveled protrusion is provided for receiving a thumb force for assisting in removing the safety device after the safety device is installed on the handgun. Preferably, the beveled protrusion has a roughened surface for assisting in engaging a thumb of a user.

In accordance with a further feature of the invention, the hammer locking end has a hammer locking surface for preventing movement of the hammer when the safety device is installed on the handgun. The hammer locking surface has a width adapted to a width of the handgun frame in the region behind the hammer of the handgun. When the safety device is snapped or locked to the frame, behind the hammer or over the hammer, the hammer is held in a forward or safe, non-firing position.

In accordance with another feature of the invention, the trigger locking end has protrusions defining a recess between the protrusions for form fitting the trigger locking end on the trigger guard. The protrusions extend below the physical structure of the trigger guard. The trigger locking end has a front face preventing a rearward movement of the trigger and a rear surface butting against the trigger guard. The front face is adapted to a shape of the trigger. The trigger locking end has cutouts formed therein. The cutouts save material costs and weight.

In accordance with an additional feature of the invention, the hammer locking end, the trigger locking end, and the structural support member are formed of plastic, rubber, plastic-rubber compounds, or other suitable compounds.

With the foregoing and other objects in view there is provided, in accordance with the invention, a method of making a safety device for a handgun having a trigger, a hammer and a trigger guard. The method includes injection molding a hammer locking end for locking the hammer, a trigger locking end for locking the trigger, and a structural support member extending between the hammer locking end and the trigger locking end.

Other characteristic features of the invention are set forth in the appended claims.

Although the invention is illustrated and described herein as embodied in a gun trigger and hammer safety device, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

A double action handgun or revolver generally includes a frame, a barrel, a handgrip, a hammer, a trigger, and a trigger guard. The handgun further includes a rotatable chambered cylinder wherein a plurality of bullets are contained so that the handgun may be fired several times without reloading.

Figure 1:
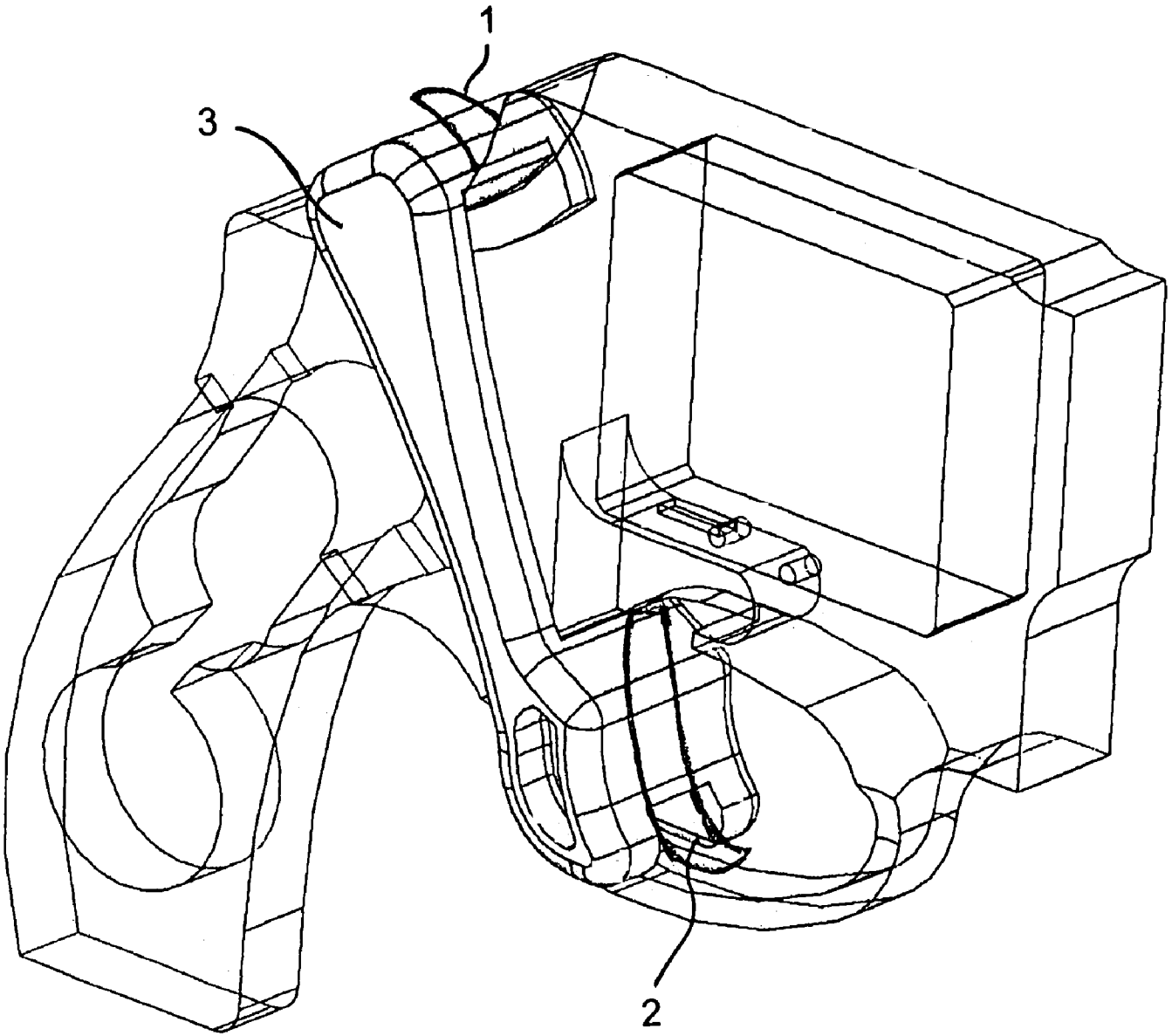
FIG. 1 is a diagrammatic, right-side, perspective view of an outline of a handgun and a safety device according to the invention.

The term double action refers to the two-part movement of the trigger during operation. Depressing the trigger results initially in a reverse movement or cocking of hammer, which in its return movement, or firing motion, revolves the chambered cylinder and brings the next bullet in line for firing. In many guns today, the hammer is integrated into the frame and cannot be seen. The invention of course can work with handguns having the traditional hammer configuration and such a hammer 1 is shown in FIG. 1. The invention works with either type of hammer. In addition, the trigger 2 is only diagrammatically shown in FIG. 1 for clarity purposes.

Since such double-action handguns are well known to those skilled in the art, further detailed discussion does not seem necessary.

Referring now to the figures of the drawings in detail and first, particularly, to FIG. 1 thereof, there is shown a handgun and a safety device 3 installed on the handgun. The safety device 3 is a clip-on, clip-off disposable or temporary safety device 3.

The invention provides a separate, from the handgun, safety device 3 manufactured of a suitable material and configured to clip-on securely and engage and lock both the hammer 1 and the trigger 2 of the handgun. The handgun can be carried concealed, and grasped and drawn with enhanced safety as the safety device 3 prevents unintended discharge of the handgun. The safety device 3 is quickly and easily unclipped by actuation of the thumb of the user and the handgun and is then ready to use.

Figure 2:
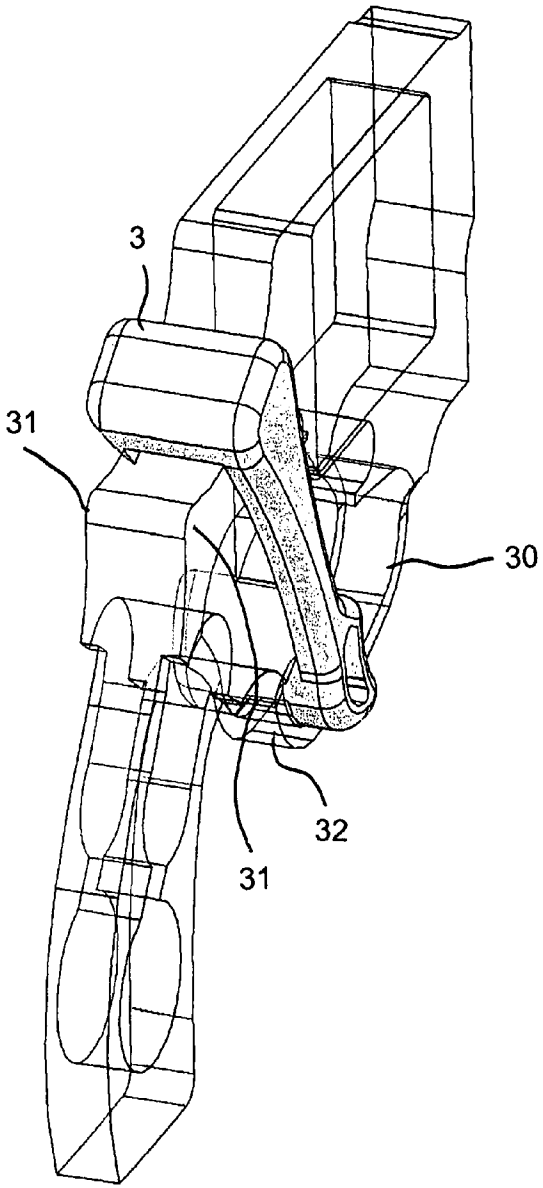
FIG. 2 is a diagrammatic, rear, perspective view of an outline of the handgun and the safety device.

FIG. 2 is a rear perspective view showing the safety device 3 on the handgun and form fit connected to the trigger guard 30 and on sides 31 of the handgun.

Figure 3:
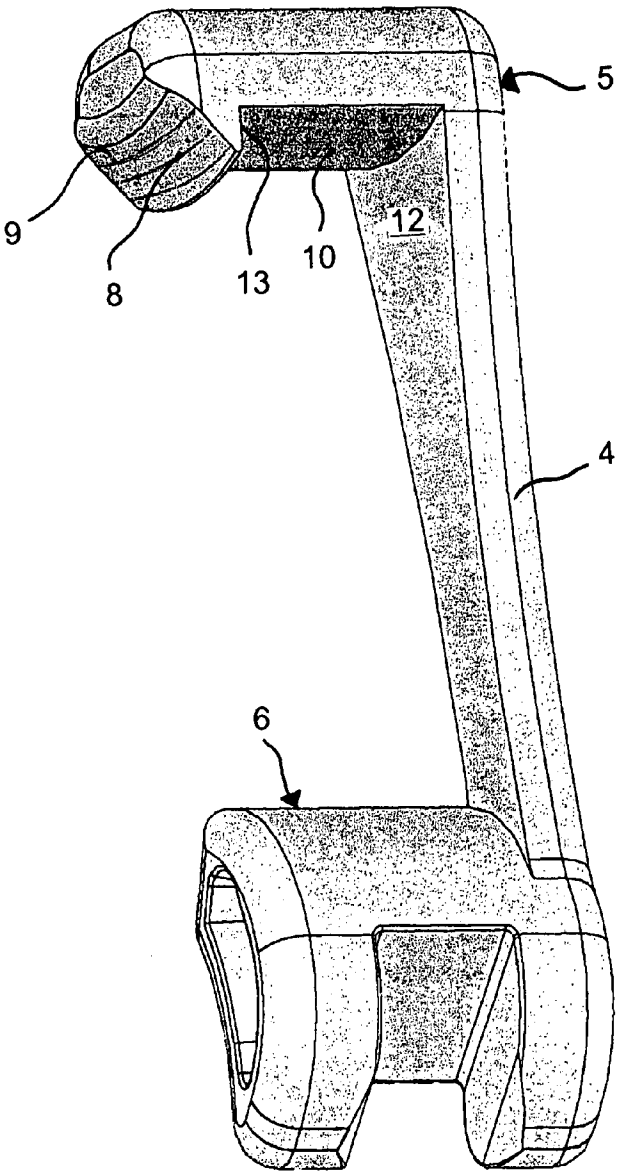
FIG. 3 is a diagrammatic, rear-side perspective view of the safety device.

FIG. 3 shows that the safety device 3 is formed of a joining member 4 that connects a hammer locking end 5 to a trigger locking end 6. The hammer locking end 5 is formed of a beveled side 8 having a roughened surface 9. The hammer locking end 5 has a first hammer locking surface 10 for locking an integrated hammer of the handgun, and a second hammer locking surface 11 (see FIG. 4) for locking a hammer 1 of a traditionally configured handgun. The hammer locking end 5 fits over the handgun as shown in FIGS. 1 and 2. More specifically, sides 12 and 13 engage the sides 31 of the handgun and make a form fitting fit. In the installed position, the first hammer locking surface 10 fits directly over the hammer and does not allow the hammer to move. In other words, it locks the hammer from going into a firing position. The second hammer locking surface 11 does the same for the traditional type hammer 1. Because the hammer locking end 5 is form fitted on the handgun, it can be quickly removed by thumb pressure being exerted on the beveled side 8. The exerted pressure lifts the beveled side 8 out of its form fit with the sides 31 of the handgun and releases the safety device 3 from the handgun 2.

Figure 4:
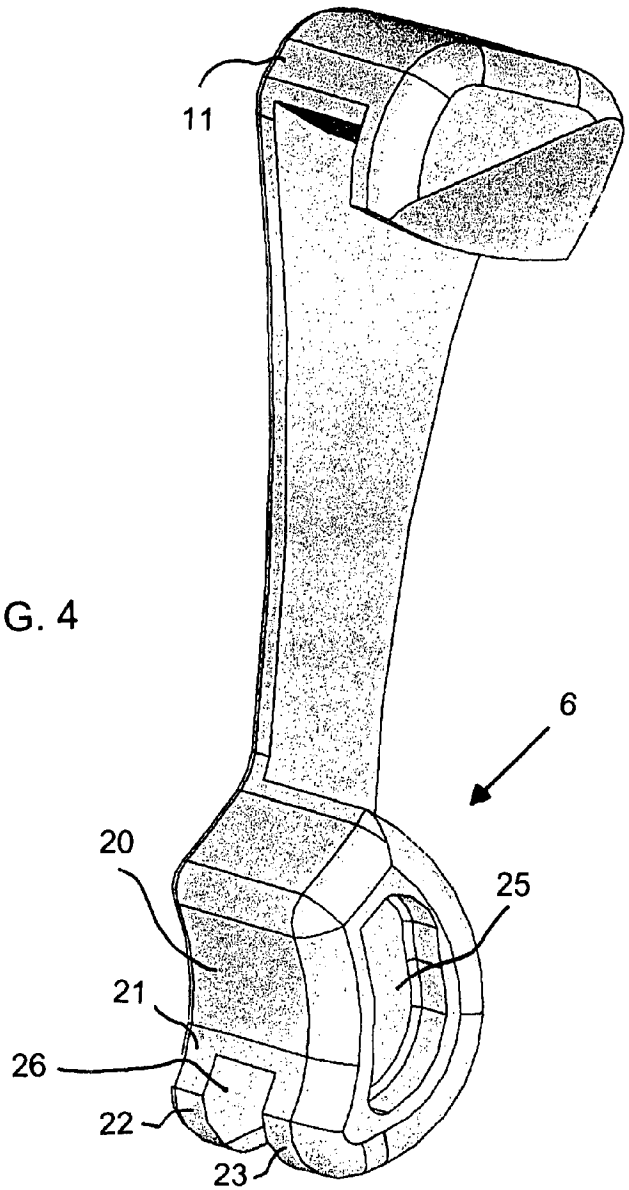
FIG. 4 is a diagrammatic, front-side perspective view of the safety device.

FIG. 4 shows a front face 20 of the trigger locking end 6 which is formed to the shape of the trigger 2. When inserted onto the handgun, the front face 20 prevents the trigger 2 from moving backwards or into the firing position. The trigger locking end 6 has a guard adapter 21 with protrusions 22, 23 that engage the trigger guard 30 and define a recess 26 for receiving the trigger guard 30. The recess 26 is adapted to the shape of the trigger guard 30. In the installed state of the safety device, the protrusions 22, 23 extend beyond the sides of the trigger guard 30. A rear surface 24 of the trigger locking end 6 engages a back surface 32 of the trigger guard 30. When in the installed state, the protrusions 22, 23 and the rear surface 24 are form fit held on the trigger guard 30. As the rear surface 24 is prevented from moving backwards by the trigger guard 30, 32, the front face 20 likewise prevents the trigger 2 from moving. The sides of the trigger locking end 6 have cut-outs 25 which lighten the weight of the safety device 3 and reduce manufacturing material costs.

To install the safety device 3, first the trigger locking end 6 is forming fittingly locked on the trigger guard 30 of the handgun. Then the hammer locking end 5 is slipped on and form fittingly connected on the sides 31 of the handgun. During the removal of the safety device 3, as pressure is exerted on the beveled side 8, the protrusions 22, 23 or walls of the recess 26 dig into the trigger guard 30 and act as a pivot point, and thus assist in the removal of the hammer locking end 5. After the hammer locking end 5 is released, an upward movement of the safety device 3, disengages the form fit of the trigger locking end 6 from the trigger guard 30.

Figure 5:
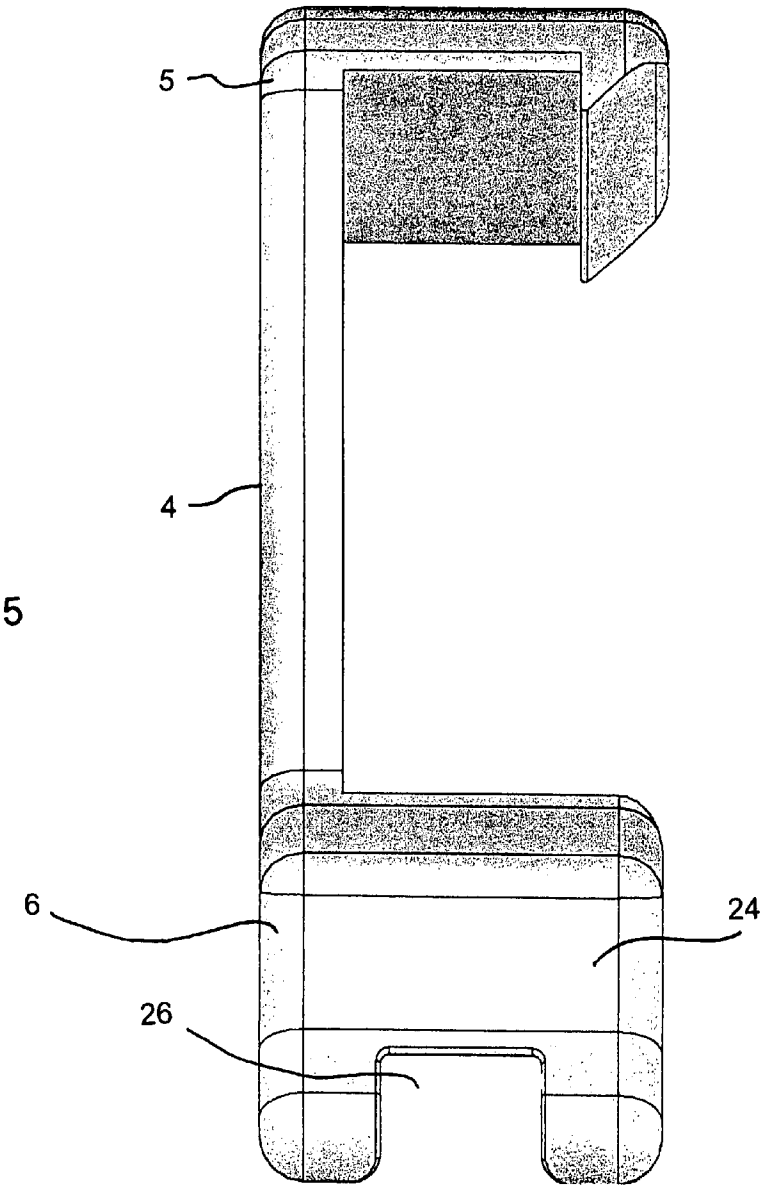
FIG. 5 is a diagrammatic, rear perspective view of the safety device.
Figure 6:
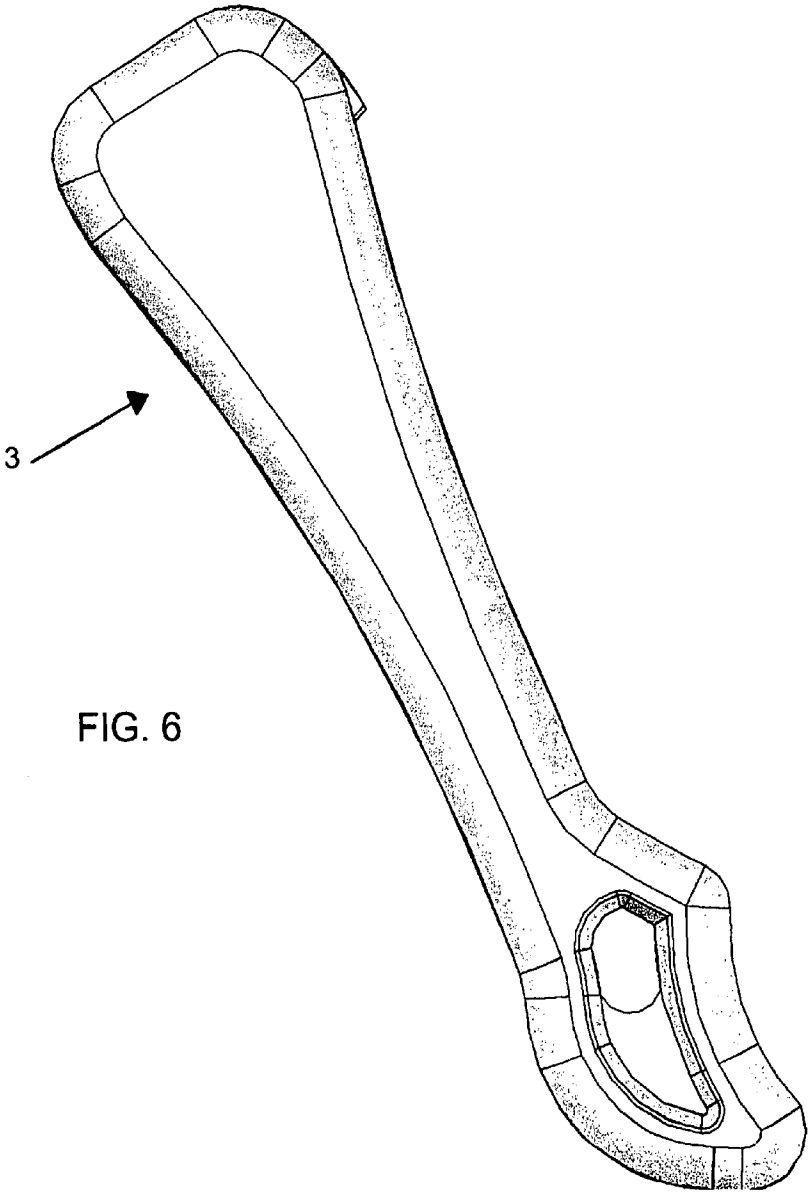
FIG. 6 is a diagrammatic, side view of the safety device.

FIG. 5 shows a rear perspective view of the safety device and FIG. 6 is a side view of the safety device. Ideally the safety device 3 is an injected molded device and is formed from plastic, rubber or a plastic-rubber compound as are commonly used in injection molding processes. In this manner, the safety device 3 is inexpensive to manufacture and is disposable.

Throughout the application, the term form fitting is used. A form fit connection is a connection where the fit is due to the shape of the items and does not require an external force to secure the fit. An external force being a force provide by a screw or other fastening type device.

I claim:

1. A safety device for a handgun having a trigger, a hammer and a trigger guard, the safety device comprising:

a hammer locking end for locking the hammer;

a trigger locking end for locking the trigger; and a structural support member extending between said hammer locking end and said trigger locking end;

said hammer locking end configured to be snapped-on above and cover-over the hammer for preventing the hammer from being cocked and said trigger locking end configured to be snapped-on over the trigger guard and disposed behind the trigger for preventing the trigger from being moved into a firing position, and permit the safety device to be unsnapped and removed solely by the thumb of a hand of a user holding the handgun.

2. The safety device according to claim 1, wherein said hammer locking end has first and second sides for form fitting to sides of the handgun.

3. The safety device according to claim 2, wherein said first side has an inner side engaging one of the sides of the handgun and an outer side having a beveled protrusion, said beveled protrusion being provided for receiving a thumb force for assisting in removing the safety device after the safety device is installed on the handgun.

4. The safety device according to claim 3, wherein said beveled protrusion has a roughened surface for assisting in engaging a thumb of a user.

5. The safety device according to claim 3, wherein said hammer locking end has a hammer locking surface for preventing movement of the hammer when the safety device is installed on the handgun.

6. The safety device according to claim 1, wherein said trigger locking end has protrusions defining a recess between said protrusions for form fitting said trigger locking end on the trigger guard.

7. The safety device according to claim 6, wherein said protrusions extend below a physical structure of the trigger guard.

8. The safety device according to claim 6, wherein said trigger locking end has a front face preventing a rearward movement of the trigger.

9. The safety device according to claim 8, wherein said trigger locking end has a rear surface butting against and following a contour of said trigger guard.

10. The safety device according to claim 8, wherein said front face is adapted to a shape of the trigger.

11. The safety device according to claim 1, wherein said trigger locking end has cutouts formed therein.

12. The safety device according to claim 1, wherein said hammer locking end, said trigger locking end, and said structural support member are formed of a material selected from the group consisting of plastic, rubber and plastic-rubber compounds.

13. The safety device according to claim 5, wherein said hammer locking surface has a width adapted to a width of a handgun frame in a region of the hammer of the handgun.

14. The safety device according to claim 3, wherein said hammer locking end has a hammer locking surface for preventing movement of the hammer when the safety device is installed on the handgun, and said beveled protrusion extending below said hammer locking surface by at least ⅛ inch.

15. The safety device according to claim 1, wherein:

said hammer locking end releasably form fits to the handgun; and said trigger locking end releasably form fits to the handgun.

16. A method of making a safety device for a handgun having a trigger, a hammer and a trigger guard, which comprises the steps of:

injection molding a hammer locking end configured to be snapped-on above and cover-over the handier and preventing the hammer from being cocked for locking the hammer, a trigger locking end configured to be snapped-on over the trigger guard and disposed behind the trigger for preventing the trigger from being moved into a firing position and permit the safety device to be unsnapped and removed solely by the thumb of a hand of a user holding the handgun, and a structural support member extending between the hammer locking end and the trigger locking end.

17. A method of operating a safety device for a handgun having a trigger, a hammer and a trigger guard, which comprises the steps of:

locking the trigger by snapping-on a trigger locking end over the trigger guard and behind the trigger to prevent the trigger from being moved into a firing position;

locking the hammer by snapping-on above and covering-over the hammer with a hammer locking end to prevent the hammer from being cocked;

interconnecting the hammer locking end and the trigger locking end with a structural support member extending therebetween; and unsnapping and removing the safety device solely by the thumb of a hand of a user holding the handgun.

18. The method according to claim 17, which further comprises applying the safety device by initially snapping-on the trigger locking end and then the hammer locking end, and removing the safety device by initially unsnapping the hammer locking end and then the trigger locking end.

19. The safety device according to claim 1, wherein said hammer locking end, said trigger locking end and said structural support member are formed in one piece.

* * * * *